US009962572B2

(12) United States Patent
Ingram et al.

(10) Patent No.: US 9,962,572 B2
(45) **Date of Patent: *May 8, 2018**

(54) LIFTING STRAP WITH WRIST SUPPORT AND ENHANCED GRIPPING PROPERTIES

(75) Inventors: Kenneth Robert Ingram, Kitchener (CA); Michele Marie Gaedke, Fairfield, CA (US)

(73) Assignee: Implus Footcare, LLC, Durham, NC (US)

( * ) Notice: Subject to any disclaimer, the term of this patent is extended or adjusted under 35 U.S.C. 154(b) by 2786 days.

This patent is subject to a terminal disclaimer.

(21) Appl. No.: 11/860,994

(22) Filed: Sep. 25, 2007

(65) Prior Publication Data

US 2008/0120755 A1 May 29, 2008

Related U.S. Application Data

(63) Continuation-in-part of application No. 11/564,118, filed on Nov. 28, 2006, now Pat. No. 8,747,284.

(51) Int. Cl.

| | |
|---|---|
| ***A63B 23/16*** | (2006.01) |
| ***A63B 21/00*** | (2006.01) |
| *A63B 21/072* | (2006.01) |

(52) U.S. Cl.

CPC ..... *A63B 21/4001* (2015.10); *A63B 21/4021* (2015.10); *A63B 21/072* (2013.01); *A63B 21/4017* (2015.10); *A63B 2209/10* (2013.01)

(58) Field of Classification Search

CPC ..... A63B 21/1434; A63B 21/1442; A63B 21/065; A63B 21/1403; A63B 21/072; A63B 21/1449; A63B 27/00; A63B 37/12; A63B 55/008; A41D 13/0015; A41D 13/082; A41D 13/088; A41D 2400/80; A41D 2400/82

USPC ..... 482/13, 49–50, 106–108, 139; 2/161.1, 2/161.4, 158, 20, 162, 170; 441/68–69; 602/294, 25; 294/25; 128/879, 77, 133; D29/117.1

See application file for complete search history.

(56) References Cited

U.S. PATENT DOCUMENTS

| | | | | | |
|---|---|---|---|---|---|
| 3,498,410 | A | * | 3/1970 | Storch | 182/96 |
| 3,774,242 | A | * | 11/1973 | Owen | 2/158 |
| 3,893,604 | A | * | 7/1975 | Skinner | 224/257 |
| 4,044,437 | A | * | 8/1977 | Ebenstein | 28/151 |
| 4,052,095 | A | * | 10/1977 | Johnson | 294/74 |
| 4,161,195 | A | * | 7/1979 | Khan | 139/383 A |
| 4,200,325 | A | * | 4/1980 | Johnson | 294/74 |
| 4,367,733 | A | * | 1/1983 | Stromgren | A61F 13/066 602/65 |
| 4,400,831 | A | * | 8/1983 | Rietz | 2/161.1 |
| 4,684,559 | A | | 8/1987 | Wasko | |
| 4,699,133 | A | * | 10/1987 | Schafer | A61F 13/00987 602/77 |

(Continued)

OTHER PUBLICATIONS

PDF dictionary reference -definition of webbing http://dictionary.reference.com/browse/webbing.*

*Primary Examiner* — Robert Long

(74) *Attorney, Agent, or Firm* — Edward S. Wright

(57) ABSTRACT

Weight lifting strap which is looped around the wrist and wrapped in helical fashion about a weight lifting bar or the like and gripped by the hand with opposite sides of the strap facing the bar and the hand, and the strap being fabricated of a woven material with rubberized strands on the side of the strap which faces the bar.

19 Claims, 6 Drawing Sheets

(56) References Cited

U.S. PATENT DOCUMENTS 4,809,974 A 3/1989 Buhr
4,843,651 A * 7/1989 Gramza et al. ..... 2/161.1
4,900,613 A * 2/1990 Green ..... 442/189
5,070,866 A * 12/1991 Alexander et al. ..... 602/19
5,219,636 A * 6/1993 Golz ..... 428/193
5,238,279 A * 8/1993 Anteau ..... 294/74
5,272,796 A * 12/1993 Nichols ..... 24/712
5,324,244 A * 6/1994 Miller et al. ..... 482/106
5,350,343 A * 9/1994 DaSilva ..... 482/106
5,419,951 A * 5/1995 Golz ..... 442/200
5,472,000 A * 12/1995 Olsen ..... 128/878
5,500,952 A * 3/1996 Keyes ..... 2/465
5,551,447 A * 9/1996 Hoffman et al. ..... 128/869
5,553,324 A * 9/1996 Emerson ..... 2/158
5,557,805 A * 9/1996 Emerson ..... 2/158
5,557,806 A * 9/1996 Caswell et al. ..... 2/161.1
5,634,213 A * 6/1997 Grover ..... 2/161.1
5,737,773 A * 4/1998 Dicker et al. ..... 2/69
5,745,920 A 5/1998 Olivier
5,746,685 A * 5/1998 Glaser ..... 482/93
5,809,570 A * 9/1998 Grover ..... 2/161.1
5,813,950 A * 9/1998 Parker ..... 482/93
5,820,526 A * 10/1998 Hoffman ..... 482/55
5,898,944 A * 5/1999 Vrany ..... 2/161.4
5,927,297 A * 7/1999 Cooper ..... 132/273
6,146,319 A * 11/2000 Tarail ..... 482/139
6,149,215 A * 11/2000 Balogh et al. ..... 294/74
6,194,629 B1 2/2001 Bernhard
6,231,488 B1 * 5/2001 Dicker et al. ..... 482/124
6,564,385 B2 5/2003 McCarthy
6,704,939 B2 3/2004 Faulconer
6,811,540 B1 * 11/2004 Ritchie ..... A61F 5/0111 128/882
6,834,397 B1 * 12/2004 Murphy ..... 2/161.1
6,990,689 B1 * 1/2006 Thellmann ..... 2/161.1
7,004,889 B2 * 2/2006 McBride ..... 482/92
7,008,355 B2 * 3/2006 Emick ..... 482/139
7,043,762 B2 * 5/2006 Greenhalgh ..... 2/16
7,118,516 B1 * 10/2006 Gouthro ..... 482/92
7,490,634 B2 * 2/2009 Resendez et al. ..... 139/423
7,537,577 B2 * 5/2009 Phelan et al. ..... 602/21
9,011,305 B2 * 4/2015 Inzer ..... A63B 71/1225 482/148
9,895,594 B2 * 2/2018 Inzer ..... A63B 71/1225
2003/0119632 A1 * 6/2003 Archuleta ..... 482/49
2005/0075227 A1 * 4/2005 Emick ..... 482/139
2005/0274753 A1 * 12/2005 Swentor et al. ..... 224/148.6
2006/0255214 A1 * 11/2006 Simone ..... 248/102
2007/0114141 A1 * 5/2007 Mikesell ..... B25H 3/006 206/207
2007/0118966 A1 * 5/2007 Beraznik ..... 2/159
2007/0122607 A1 * 5/2007 Hisano ..... B32B 3/26 428/304.4
2007/0267084 A1 * 11/2007 Pereira et al. ..... 139/116.1
2008/0085817 A1 * 4/2008 Brentlinger et al. ..... 482/55
2008/0090705 A1 * 4/2008 Wang ..... 482/106
2009/0090378 A1 * 4/2009 Chudzik et al. ..... 132/273
2009/0162651 A1 * 6/2009 Rios et al. ..... 428/354
2009/0275448 A1 * 11/2009 Fishman ..... 482/139
2012/0059302 A9 * 3/2012 Hou ..... B32B 5/04 602/75
2012/0066809 A1 * 3/2012 Goth ..... A41D 13/088 2/16

* cited by examiner

LIFTING STRAP WITH WRIST SUPPORT AND ENHANCED GRIPPING PROPERTIES

RELATED APPLICATION

Continuation-in-part of Ser. No. 11/564,118, filed Nov. 28, 2006.

BACKGROUND OF THE INVENTION

Field of Invention

This invention pertains generally to weight lifting and fitness equipment and, more particularly, to a strap for improving the grip on such equipment.

Related Art

Lifting straps are used as an aid in weight lifting and fitness exercises to improve the user's grip on a bar and to allow him to concentrate on the muscles he wants to exercise rather than the ones which would otherwise be used in gripping the bar. The strap is typically looped about the wrist and then wrapped about the bar where it is gripped by the hand. Examples of such straps are found in U.S. Pat. Nos. 4,809,974, 5,324,244, 5,745,920 and 7,004,889.

OBJECTS AND SUMMARY OF THE INVENTION

It is in general an object of the invention to provide a new and improved strap for use in weight lifting and the like.

Another object of the invention is to provide a lifting strap of the above character which overcomes the limitations and disadvantages of the prior art.

These and other objects are achieved in accordance with the invention by providing a weight lifting strap which is wrapped in helical fashion about a bar and gripped by a hand with opposite sides of the strap facing the bar and the hand, and the strap being fabricated of a woven material with rubberized strands on the side of the strap which faces the bar.

DETAILED DESCRIPTION

Figure 1:
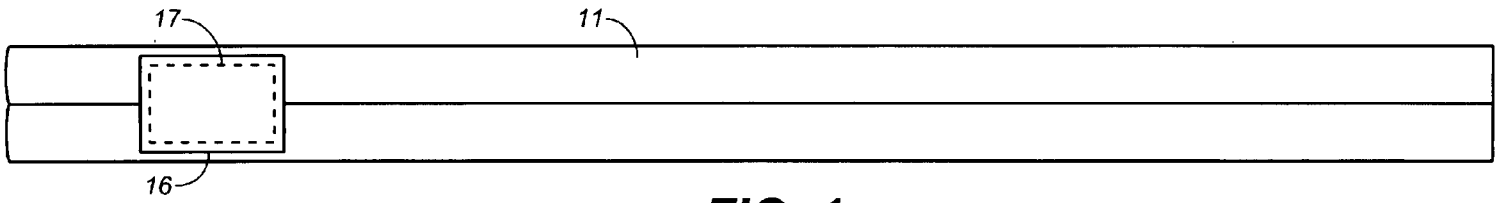
FIGS. 1 and 2 are front and rear elevationals view of one embodiment of a lifting strap according to the invention.

As illustrated in the drawings, lifting strap 11 is woven of a durable, flexible material such as nylon, with strands 12 of a rubberized material in the weave on the back side of the strap. At one end of the strap, the end portion 13 is folded back upon itself and stitched to form a loop 14, with the rubberized strands on the inner side of the loop. A label 16 is affixed to the front side of the strap near the loop and, in the embodiment illustrated, is secured to the strap by the same stitches 17 that form the loop.

Figure 4:
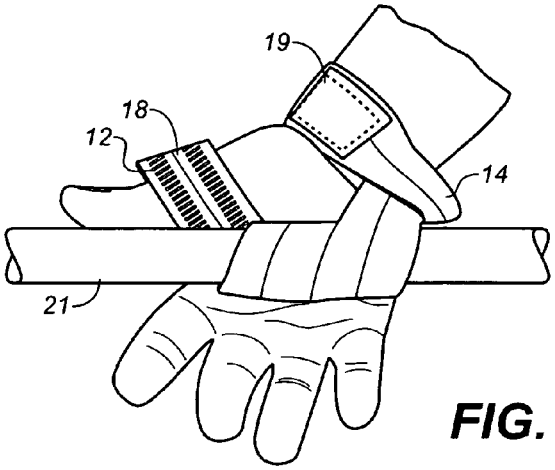
FIG. 4 is an isometric view illustrating use of the embodiment of FIGS. 1 and 2.
Figure 5:
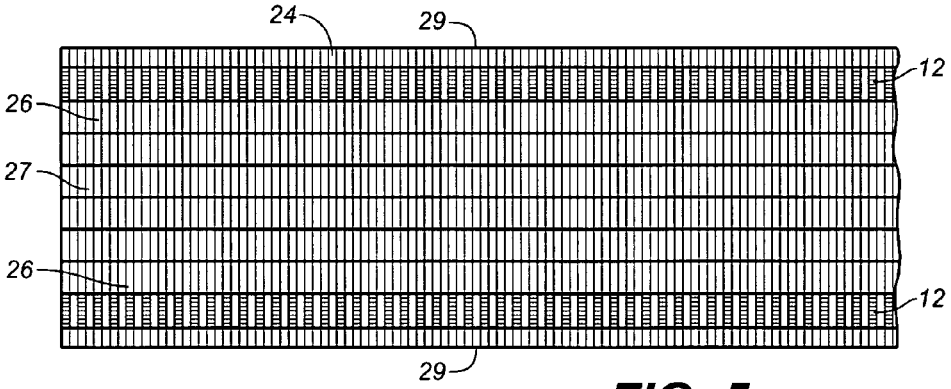
FIG. 5 is a fragmentary plan view of a web of woven material from which the embodiment of FIGS. 1 and 2 is made.
Figure 6:
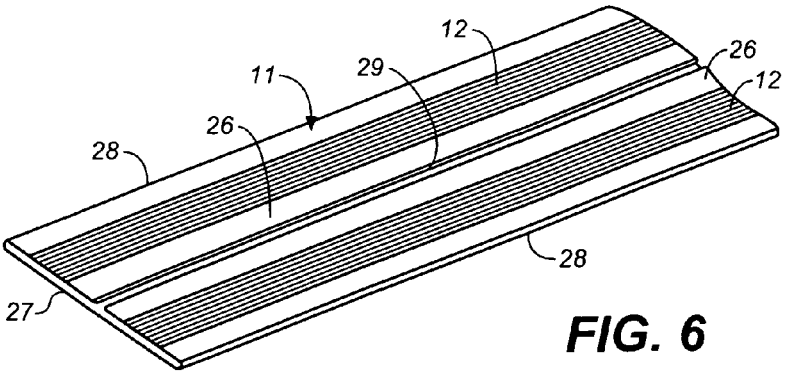
FIG. 6 is a fragmentary isometric view of the web of FIG. 5 being folded to form the embodiment of FIGS. 1 and 2.

The strap typically has a length on the order of 20-22 inches and a width on the order of 1.5 inches. As illustrated in FIG. 4, it is looped about the wrist of a user by passing the free end 18 of the strap through loop 14 to form a larger loop 19 which encircles the wrist, with the free portion of the strap and being wrapped in helical fashion about a weight lifting bar 21, or the like, with the rubberized strands 12 facing the bar.

The rubberized strands extend lengthwise of the strap and provide enhanced gripping properties for the side of the strap which faces the object be gripped. In the embodiment illustrated, the rubberized strands are arranged in two groups 22 of eight strands each, and the two groups are disposed side-by-side and spaced laterally apart along the strap.

Figure 2:
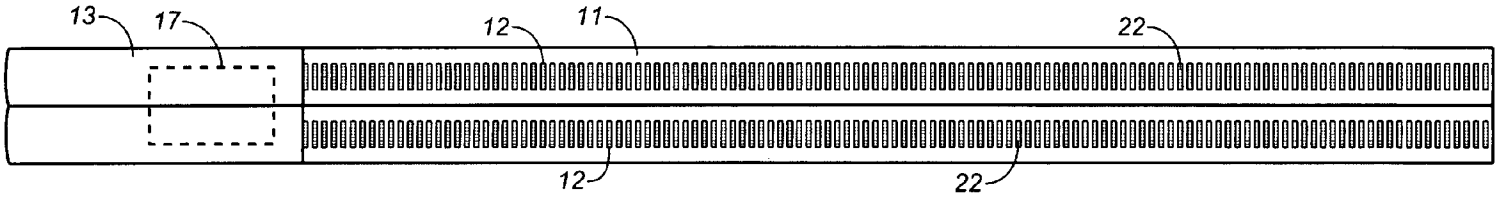
Figure 3:
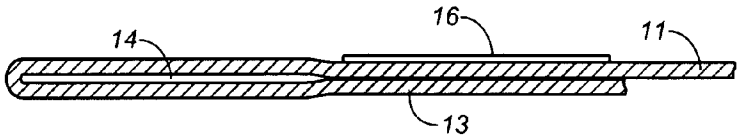
FIG. 3 is a fragmentary side elevational view of the embodiment of FIGS. 1 and 2.

In the embodiment of FIGS. 1 and 2, the strap is made from a web 24 of woven fabric which is approximately twice as wide as the finished strap, with the two groups of rubberized strands 12 in lateral edge portions 26 of the web. The edge portions are approximately one-fourth as wide as the web and half as wide as the finished strap, and they are folded over the central portion 27 of the web along longitudinally extending fold lines 28, with the selvedge edges 29 of the web coming together near the longitudinal centerline of the strap. The folded-over edge portions are secured to the central portion by suitable means such as over-weaving or stitching to form a substantially flat two layer strap, with the central portion of the web serving as a base for the layer with the rubberized strands.

Once the two layer structure has been formed, it is cut into lengths for the individual straps, and the raw ends of the individual straps are stitched to prevent them from fraying. One end portion of each strap is then folded over and stitched to itself to form loop 14 and to secure label 16 to the strap.

Figure 7:
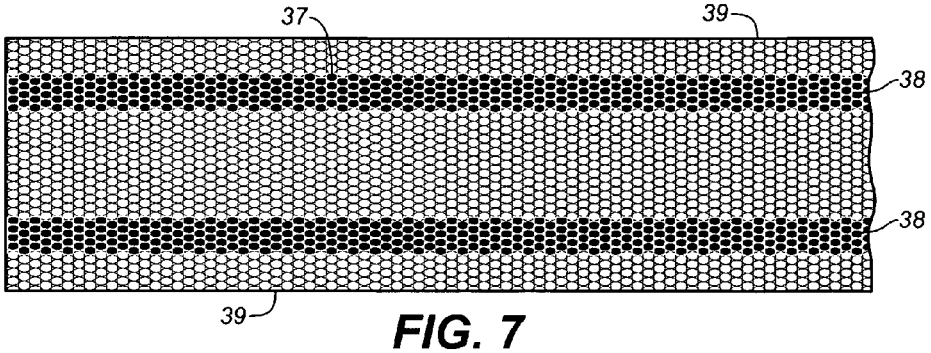
FIGS. 7 and 8 are top and bottom plan views of another embodiment of a woven material for use in a lifting strap according to the invention.
Figure 8:
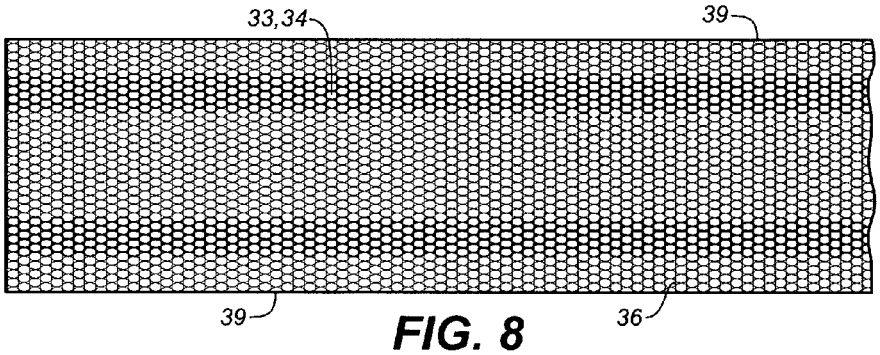
Figure 9:
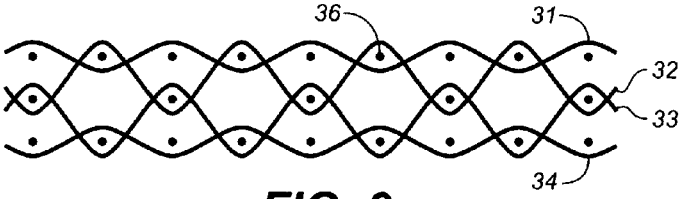
FIGS. 9 and 10 are enlarged, fragmentary cross-sectional views of the embodiment of FIGS. 7 and 8.
Figure 10:
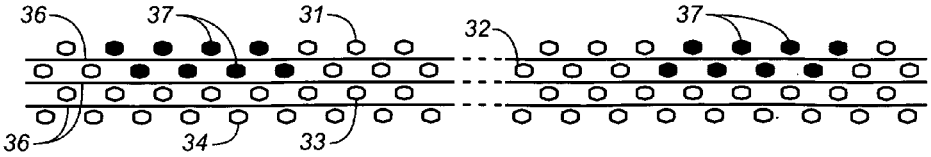

In the embodiment of FIGS. 7 and 8, the material is a flat, multi-layer woven fabric with rubberized strands in the top layer only. In this material, four layers of warp strands 31, 32, 33, 34 are woven together in an over-under pattern with a weft strand 36 which is common to all of the layers. As best seen in FIG. 9, the two uppermost layers 31, 32 are woven together, as are the two lowermost layers 33, 34. Inner layers 32, 33 are also woven together to form an interlocking structure. Rubberized strands 37 are included in the top layer of warp strands and are woven only with the strands in the second layer. Hence, the rubberized strands are confined to the top layer of the weave and do not go all the way through the material.

In this embodiment, rubberized strands 37 are arranged in two groups 38, 38 of eight strands each near the edges 39 of the material.

When formed into a lifting strap, the flat interwoven fabric is positioned with the rubberized strands on the back side of the strap. Then, as described above, one end portion of the strap is folded back upon itself and stitched to form a loop, with the rubberized strands on the inner side of the loop, and a label is affixed to the front side of the strap near the loop. This strap is used in the same manner as the embodiment of FIGS. 1 and 2.

Figure 11:
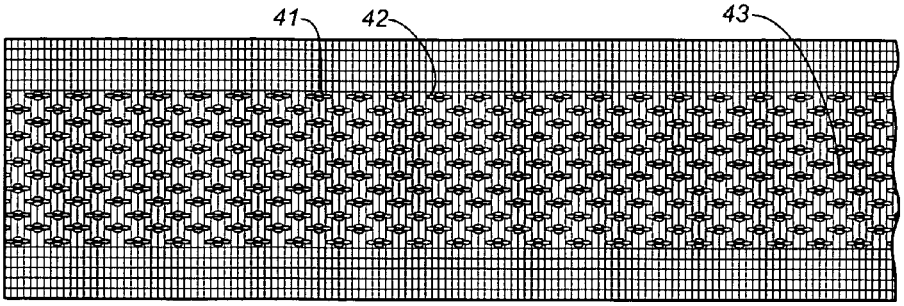
FIGS. 11 and 12 are top plan views of another embodiment of a woven material for use in a lifting strap according to the invention.
Figure 12:
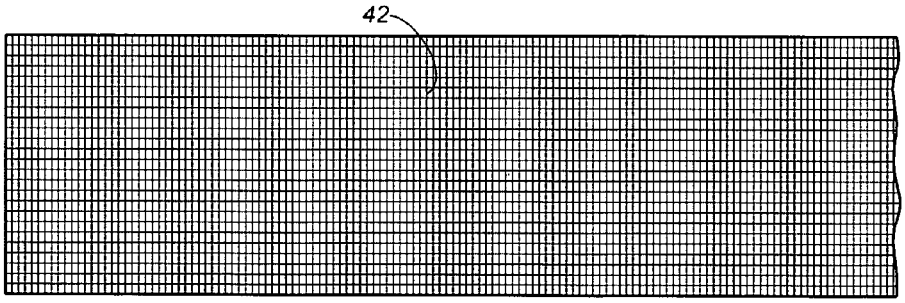

The embodiment of FIGS. 11 and 12 is similar to the embodiment of FIGS. 7 and 8 except for the number and the location of the rubberized warp strands in the upper layer of the fabric. In this embodiment, the rubberized strands 41 are arranged in groups of three, with non-rubberized strands 42 between the groups, and woven into a diamond shaped pattern in the central portion 43 of the fabric. This material is used in the same manner as the embodiment of FIGS. 7 and 8 in making a strap, with the rubberized strands on the back side of the strap for engagement with the bar or object to be lifted.

Figure 13:
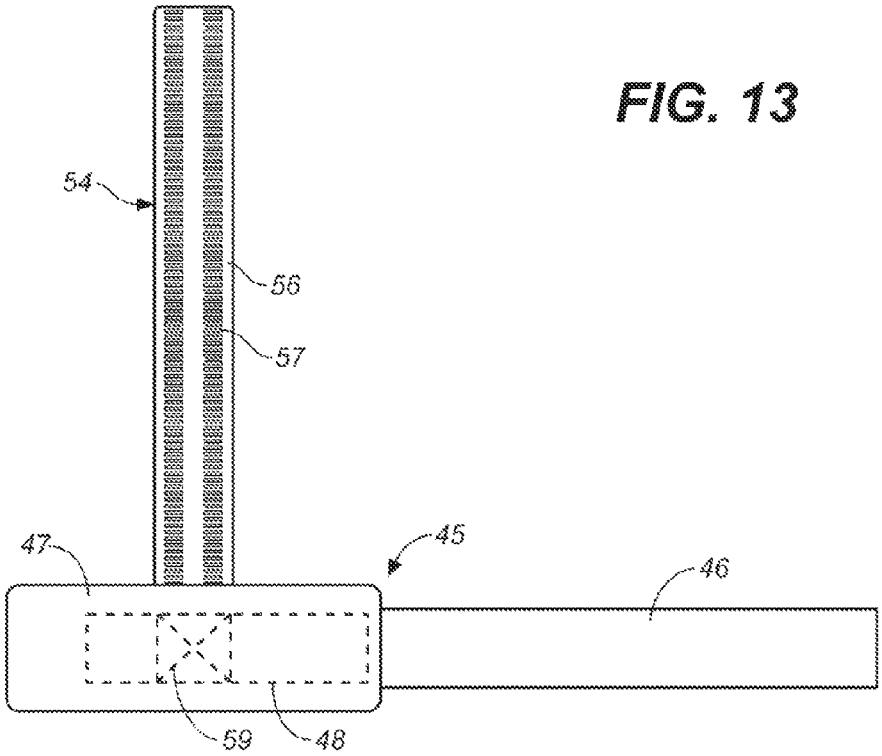
FIGS. 13 and 14 are front and rear elevational views of another embodiment of a lifting strap incorporating the invention.
Figure 14:
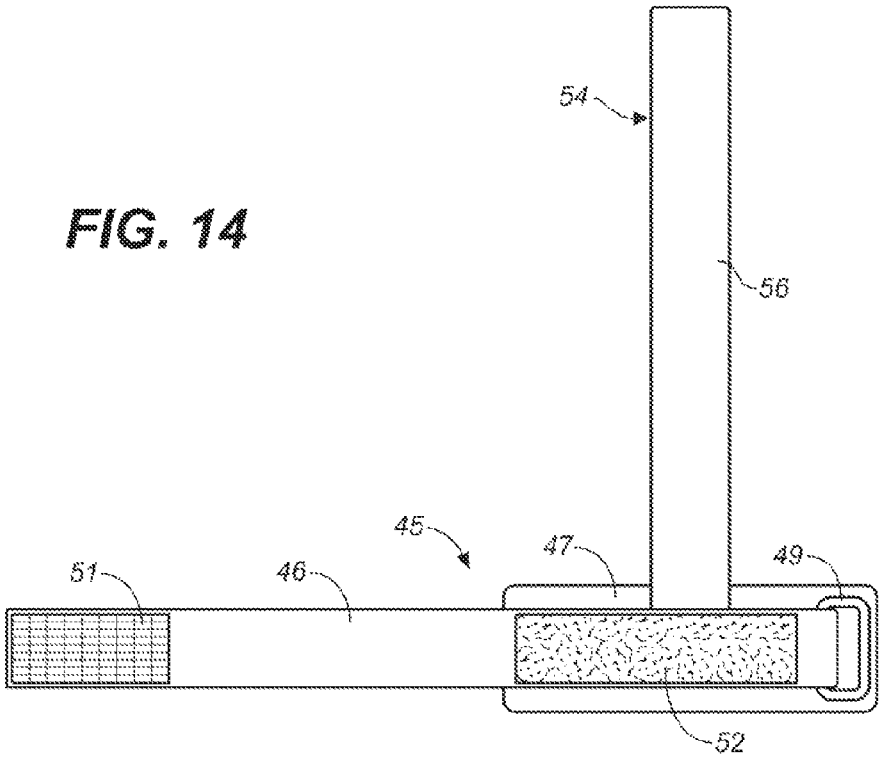

In the embodiment of FIGS. 13-14, the lifting strap includes a wrist wrap 45 comprising an elongated band 46 of flexible material such as a nylon web with a cushion or pad 47 of a material such as neoprene toward one end of the band. The cushion is on the front side of the band and is attached to the band by stitching 48. A buckle 49 is attached to the end of the band near the cushion, with the end portion of the band being wrapped about one leg of the buckle and stitched to an adjacent portion of the band to secure the buckle.

Hook and loop fasteners 51, 52 are attached to the back side of wrist band 46 for securing the device about the wrist of a person using it. In the embodiment illustrated, hook fastener 51 is near the free end of the band, and loop fastener 52 is behind the cushion, with the loop faster being longer than the hook fastener so that the hook fastener can be engaged with different portions of the loop fastener to accommodate wrists of different sizes.

A grip strap 54 extends from the upper side of cushion 47. This strap is similar in structure to strap 11 in the embodiment of FIGS. 1 and 2, and consists of an elongated length of flexible fabric 56, such as nylon, with rubberized strands 57 woven into the fabric on the front side of the strap. Alternatively, strap 54 can be similar in structure to the embodiment of FIGS. 7 and 8 or the embodiment of FIGS. 11 and 12, or it can be of other suitable structure with enhanced gripping properties on one side of the strap. In the embodiment illustrated, the proximal end portion of the strap is disposed between the back side of cushion 47 and the front side of wrist band 46, as viewed in FIG. 13, and is affixed to the wrist band and cushion by stitching 59, with the rubberized strands on the side of the gripping strap facing the cushion and not on the side facing the wrist band.

Figure 15:
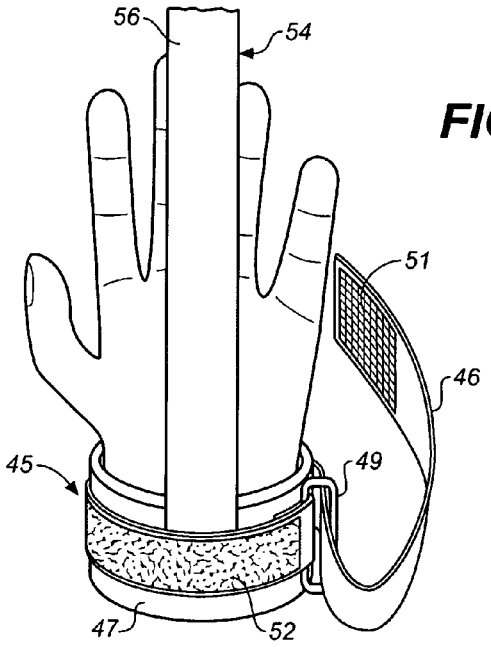
FIGS. 15 and 16 are isometric views illustrating use of the embodiment of FIGS. 13 and 14.

In use, the wrist wrap 45 is positioned about the wrist as illustrated in FIG. 15, with cushion 37 on the front or palm side of the wrist, buckle 48 on the outer side, and grip strap 54 extending along the palm and fingers of the hand. The free end of wrist band 46 is passed through the buckle, folded back over the remainder of the band and pulled to tighten the wrap snugly about the wrist. The free end portion is pressed against the portion of the band behind the cushion to engage the hook portion 51 of the fastener with the loop portion 52 and thereby secure the device in place.

Figure 16:
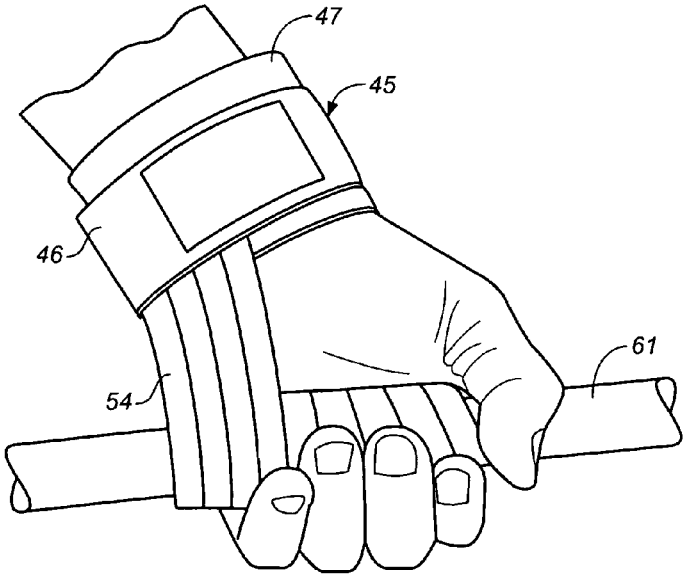

Then, as illustrated in FIG. 16, the free portion of grip strap 54 is wrapped in helical fashion about bar 61 or object to be lifted, with the rubberized strands 57 facing the bar. When the object is lifted, the weight of the object is transferred to the wrist, and the padded wrist wrap provides both support and cushioning for the wrist during lifting.

The invention has a number of important features and advantages. The rubberized strands facing the bar provide enhanced gripping properties with better control and greater safety in the lifting of heavier weights.

It is apparent from the foregoing that a new and improved lifting strap has been provided. While only certain presently preferred embodiments have been described in detail, as will be apparent to those familiar with the art, certain changes and modifications can be made without departing from the scope of the invention as defined by the following claims.

The invention claimed is:

1. A lifting strap comprising an elongated, flexible wrist band, a cushion on one side of the wrist band, a gripping strap comprising an elongated length of flexible fabric with rubberized strands woven into the fabric on only one side of the gripping strap, one end portion of the gripping strap being disposed between and affixed to the wrist band and the cushion with the rubberized strands on the side of the gripping strap facing the cushion and not on the side facing the wrist band, and means for securing the wrist band about the wrist of a person with the cushion on the palm side of the wrist and the gripping strap extending across the palm and fingers in position to be wrapped about an object gripped by the hand with the rubberized strands facing the object.

2. The lifting strap of claim 1 wherein the wrist band passes through a buckle affixed to one end of the wrist band and is folded back upon itself, and the means for securing the wrist band about the wrist includes hook and loop fasteners which are affixed to one side of the wrist band and face each other when the wrist band is folded back upon itself.

3. The lifting strap of claim 2 wherein the buckle is positioned on the outer side of the wrist.

4. A lifting strap comprising an elongated, flexible wrist band, a cushion on one side of the wrist band, a gripping strap comprising an elongated length of nylon fabric with rubber strands woven into the fabric on only one side of the gripping strap, one end portion of the gripping strap being disposed between and affixed to the wrist band and the cushion with the rubber strands on the side of the gripping strap facing the cushion and not on the side facing the wrist band, and means for securing the wrist band about the wrist of a person with the cushion on the palm side of the wrist and the gripping strap extending across the palm and fingers in position to be wrapped about an object gripped by the hand with the rubber strands facing the object.

5. A lifting strap comprising a padded wrist band encircling the wrist of a person, and a gripping strap comprising an elongated length of flexible fabric with rubberized strands woven into the fabric on only one side of the gripping strap extending from the wrist band and being wrapped in helical fashion about an object gripped by the person with the rubberized strands engaging the object and the side without the rubberized strands being gripped by the hand of the person.

6. The lifting strap of claim 5 wherein the wrist band comprises an elongated band of flexible material which encircles the wrist and a cushion on one side of the band for engagement with the front side of the wrist.

7. The lifting strap of claim 5 including a buckle affixed to one end of the wrist band, hook and loop fasteners affixed to one side of the wrist band for securing the band about the wrist with a portion of the band being passed through the buckle and folded back upon itself and secured by the fasteners.

8. The lifting strap of claim 7 wherein the buckle is positioned on the outer side of the wrist.

9. A lifting strap comprising a padded wrist band encircling the wrist of a person, and a gripping strap comprising an elongated length of nylon fabric with rubber strands woven into the fabric on only one side of the gripping strap extending from the wrist band and being wrapped in helical fashion about an object gripped by the person with the rubber strands engaging the object and the side without the rubber strands being gripped by the hand of the person.

10. The lifting strap of claim 1 wherein the gripping strap is affixed to the wrist band by stitching.

11. The lifting strap of claim 1 wherein the cushion is affixed to the wrist band by stitching.

12. The lifting strap of claim 1 wherein the gripping strap has two superposed layers, with the rubberized strands being woven into only one of the layers.

13. The lifting strap of claim 1 wherein the gripping strap is formed from a web of fabric having two groups of rubberized strands woven therein, with one portion of the web being folded over and secured to another to form a two layer structure with the two groups of rubberized strands disposed side by side in one of the layers.

14. The lifting strap of claim 13 wherein the rubberized strands are woven into edge portions of the web, and the edge portions are folded over and secured to a central portion.

15. The lifting strap of claim 5 wherein the elongated length of flexible fabric has two superposed layers, with the rubberized strands being woven into only one of the layers.

16. The lifting strap of claim 5 wherein the elongated length of flexible fabric is formed from a web of fabric having two groups of rubberized strands woven therein, with one portion of the web being folded over and secured to another to form a two layer structure with the two groups of rubberized strands disposed side by side in one of the layers.

17. The lifting strap of claim 16 wherein the rubberized strands are woven into edge portions of the web, and the edge portions are folded over and secured to a central portion.

18. A lifting strap comprising an elongated, flexible wrist band, a cushion on one side of the wrist band, a gripping strap comprising an elongated length of flexible fabric with rubber strands woven into the fabric on only one side of the gripping strap, one end portion of the gripping strap being disposed between and affixed to the wrist band and the cushion with the rubber strands on the side of the gripping strap facing the cushion and not on the side facing the wrist band, and means for securing the wrist band about the wrist of a person with the cushion on the palm side of the wrist and the gripping strap extending across the palm and fingers in position to be wrapped about an object gripped by the hand with the rubber strands facing the object.

19. A lifting strap comprising a padded wrist band encircling the wrist of a person, and a gripping strap comprising an elongated length of flexible fabric with rubber strands woven into the fabric on only one side of the gripping strap extending from the wrist band and being wrapped in helical fashion about an object gripped by the person with the rubber strands engaging the object and the side without the rubber strands being gripped by the hand of the person.

* * * * *